US005564912A

United States Patent [19]

Peck et al.

[11] Patent Number: 5,564,912

[45] Date of Patent: Oct. 15, 1996

[54] WATER DRIVEN PUMP

[76] Inventors: William E. Peck, 6801 Camden, #12, Groves, Tex. 77619; Larry G. Locke, 9221 Northridge, Orange, Tex. 77632

[21] Appl. No.: 533,270

[22] Filed: Sep. 25, 1995

[51] Int. Cl.[6] ..... F04B 17/00

[52] U.S. Cl. ..... 417/396; 417/404

[58] Field of Search ..... 417/396, 404

[56] References Cited

U.S. PATENT DOCUMENTS

| | | | |
|---|---|---|---|
| 354,091 | 12/1886 | Bicknell | 417/404 |
| 444,994 | 1/1891 | Shiring | 417/404 X |
| 525,731 | 9/1894 | Walther | 417/404 |
| 876,849 | 1/1908 | Starrett | 417/404 X |
| 1,746,165 | 2/1930 | Porte | 417/404 X |
| 2,041,394 | 5/1936 | Belcher . | |
| 3,861,166 | 1/1975 | Goldsberry | 417/396 X |
| 4,174,928 | 11/1979 | Austin . | |
| 4,224,013 | 9/1980 | Davis | 417/404 |
| 4,627,794 | 12/1986 | Silva . | |
| 4,761,118 | 8/1988 | Zanarini . | |
| 5,094,596 | 3/1992 | Erwin et al. . | |
| 5,110,267 | 5/1992 | Giordani | 417/404 |
| 5,123,719 | 6/1992 | Willemsen | 417/404 |
| 5,324,175 | 6/1994 | Sorensen et al. . | |
| 5,394,693 | 3/1995 | Plyter . | |

FOREIGN PATENT DOCUMENTS

| | | |
|---|---|---|
| 2159890 | 12/1985 | United Kingdom . |
| WO84/02557 | 7/1984 | WIPO . |

*Primary Examiner*—Richard E. Gluck
*Attorney, Agent, or Firm*—Richard C. Litman

[57] ABSTRACT

A fluid driven pump uses a working fluid under pressure to run a pump for pumping a product fluid. The pump includes first and second cylinders positioned end-to-end. Each cylinder houses a piston, the pistons being linked so as to move together. A piston rod projects from an end of one of the cylinders and operates valve gear which alternatingly direct working fluid to opposite sides of one of the pistons, or to opposite sides of the assembly formed by the two linked pistons. This arrangement results in the reciprocating movement of the pistons which can then be used to pump the product fluid. In another embodiment, two pumps of the type described above are used with the piston rod of each being used to operate the valve gear controlling the other. In yet another embodiment, a rotary turbine, driven by working fluid under pressure and having a common shaft with the impeller of a centrifugal pump, is used to pump the product fluid.

12 Claims, 6 Drawing Sheets

WATER DRIVEN PUMP

BACKGROUND OF THE INVENTION

1. Field of the Invention

The present invention relates to a pump, driven by water under pressure, for pumping viscous fluids.

2. Description of the Prior Art

Pumps used for pumping fluids are most commonly powered by electric or internal combustion engines. In many circumstances it may be very inconvenient to provide electrical power or an auxiliary engine to drive a pump. As an example, in the fire fighting field it is often times desirable to have an auxiliary pump for delivering fluids, such as fire retardant foams, to the high pressure hoses or nozzles used for extinguishing fires. The auxiliary pump used for pumping fire retardant foams usually are powered by electric motors or small internal combustion (IC) engines. When using the electrically powered pumps in areas where electricity is not available, auxiliary generators must also be carried in the fire engine. The electric motor and its associated generator, or the IC engine are heavy and cumbersome and take up valuable storage space in the fire engine. It would be possible to modify the fire engine and add a fire retardant foam pump that runs off the engine of the fire engine in the same manner as the pumps that supply water to the fire hoses. However, this approach would necessitate expensive modifications to the fire engine, and would be very difficult in older fire engines. Therefore, a need exists in the art for a fire retardant foam pump that can be driven by, for example, water supplied by one of the fire engines own high pressure water hoses.

It should be borne in mind that the fire fighting field is mentioned only as one example of a field where the present invention may be applied. The pump of the present invention is generally applicable to any situation where an inexpensive means is needed to pump a fluid and a plentiful supply of another fluid under pressure is readily available.

Hydraulically driven reversing pistons have been proposed in the prior art. However, none of the prior art teach or suggest the valve actuation mechanisms of the present invention.

U.S. Pat. No. 2,041,394, issued to Mark K. Belcher on May 19, 1936, shows a fire extinguisher and blowout preventer for oil wells. Belcher shows a piston and cylinder arrangement designed for using steam pressure to eject fire extinguishing chemicals from the cylinder in the event of a well blowout. The Belcher piston is not configured for reciprocating operation, and all the valves to the cylinder are manually operated.

U.S. Pat. No. 4,174,928, issued to Richard D. Austin on Nov. 20, 1979, shows a reciprocating concrete pump driven by a hydraulic actuator. The hydraulic actuator is a cylinder housing a reversing piston. At each end of the cylinder is and inlet for high pressure hydraulic fluid. A reversing valve switches high pressure hydraulic fluid supply from one inlet to the other at the end of each piston stroke. The piston of Austin is tapered to allow hydraulic fluid to "get behind the piston to start the return stroke". The hydraulic actuator of Austin has no provision for periodically connecting any of the inlets to an outlet for the hydraulic fluid ahead of the piston.

U.S. Pat. No. 4,627,794, issued to Ethan A. Silva on Dec. 9, 1986, shows a fluid pressure intensifier having a fixed piston positioned between two moving pistons housed within a cylinder. The valves of the Silva device are hydraulically operated rather than mechanically operated, thus Silva lacks the valve actuation mechanism of the present invention.

U.S. Pat. No. 4,761,118, issued to Franco Zanarini on Aug. 2, 1988, shows a hydraulically driven compressor that uses reciprocating pistons housed in respective cylinders. Zanarini does not teach or suggest the valve actuation mechanism of the present invention.

U.S. Pat. No. 5,094,596, issued to Larry R. Erwin et al. on Mar. 10, 1992, shows a pneumatically driven reciprocating pump. Erwin et al. do not teach or suggest the valve actuation mechanism of the present invention.

U.S. Pat. No. 5,324,175, issued to Harold P. Sorensen et al. on Jun. 28, 1994, shows a pneumatically driven compressor using a shuttle valve to switch pneumatic pressure between different sides of the driving or power piston. Sorensen et al. do not teach or suggest the valve actuation mechanism of the present invention.

U.S. Pat. No. 5,394,693, issued to Walter J. Plyter on Mar. 7, 1995, shows a pneumatically driven hydraulic pump which uses a sensor actuated switching valve to switch pneumatic pressure between different sides of the driving or power piston. Plyter does not teach or suggest the valve actuation mechanism of the present invention.

United Kingdom Patent Document Number 2 159 890 A, by Karl Bittel et al. published on Dec. 11, 1985, shows a double acting pressure intensifier which uses a fluid driven control spool. Bittel et al. do not teach or suggest the valve actuation mechanism of the present invention.

PCT Patent Document Number WO 84/02557, by Ethan A. Silva published on Jul. 5, 1984, shows a fluid pressure intensifier having a fixed piston positioned between two moving pistons housed within a cylinder. The valves of the Silva device are hydraulically operated rather than mechanically operated, thus Silva lacks the valve actuation mechanism of the present invention.

The product brochure by the Rosenbauer company describes the DELTAMATIC™ pumping system which incorporates a reciprocating piston pump. The brochure does not show the valve actuating mechanism of the present invention.

None of the above inventions and patents, taken either singly or in combination, is seen to describe the instant invention as claimed.

SUMMARY OF THE INVENTION

The present invention is directed to a fluid driven pump which uses a working fluid under pressure to run a pump for pumping a product fluid. The pump includes first and second cylinders positioned end-to-end. Each cylinder houses a piston, the pistons being linked so as to move together. A piston rod projects from an end of one of the cylinders and operates valve gear which alternatingly direct working fluid to opposite sides of one of the pistons, or to opposite sides of the assembly formed by the two linked pistons. This arrangement results in the reciprocating movement of the pistons which can then be used to pump the product fluid. In another embodiment, two pumps of the type described above are used with the piston rod of each being used to operate the valve gear controlling the other. In yet another embodiment, a rotary turbine, driven by working fluid under pressure and having a common shaft with the impeller of a centrifugal pump, is used to pump the product fluid.

Accordingly, it is a principal object of the invention to provide a device that uses one fluid under pressure to pump another.

It is another object of the invention to provide a fluid driven device for pumping a fluid that can provide a pressure intensifying effect.

It is a further object of the invention to provide a fluid driven pump that is portable and occupies a relatively small space.

Still another object of the invention is to provide a fluid driven pump that can be manufactured using off-the-shelf components.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
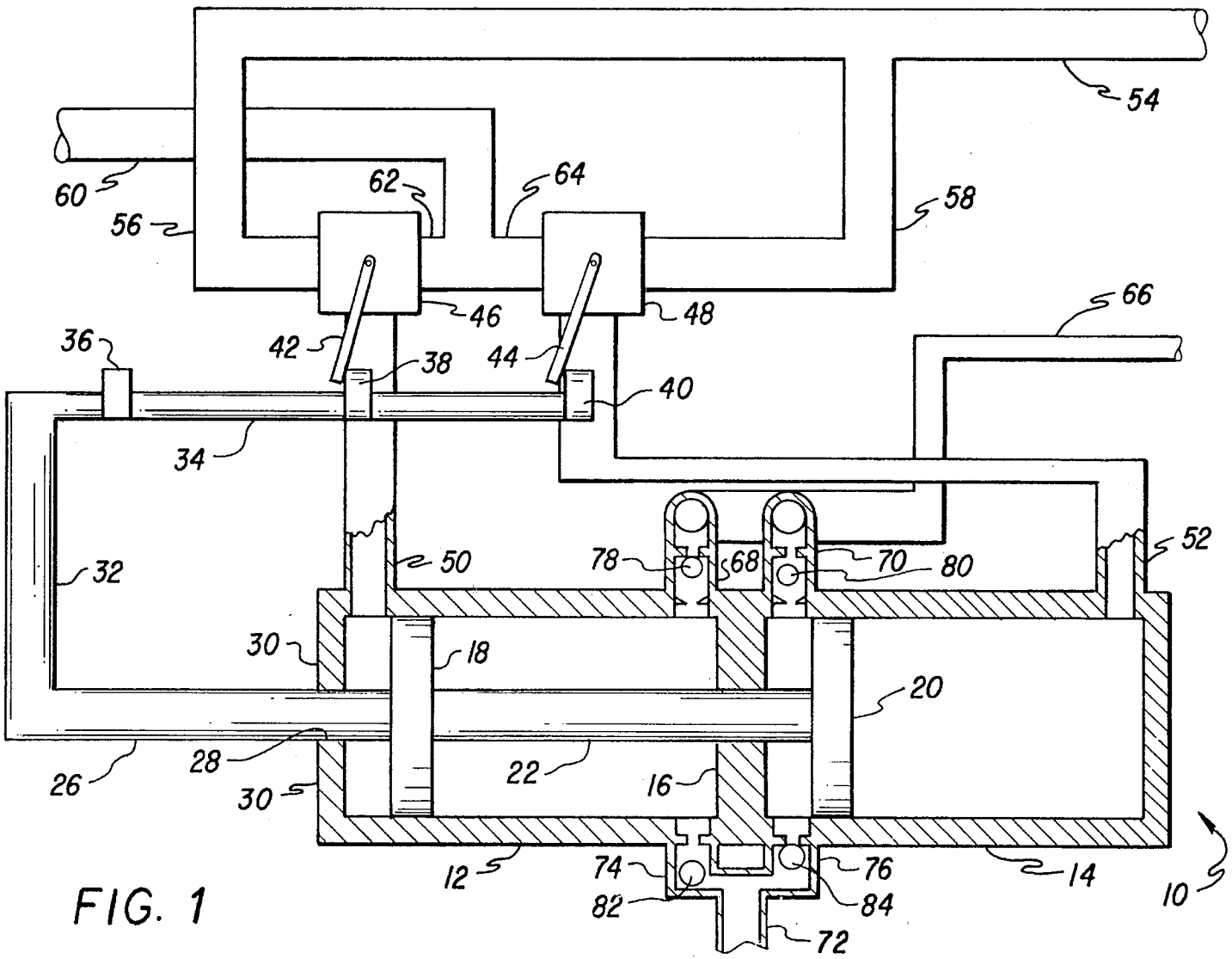
FIG. 1 is a schematic of the first embodiment of the present invention, which uses three-way valves and the middle two chambers for pumping product fluid, at the start of the pumping cycle.
Figure 2:
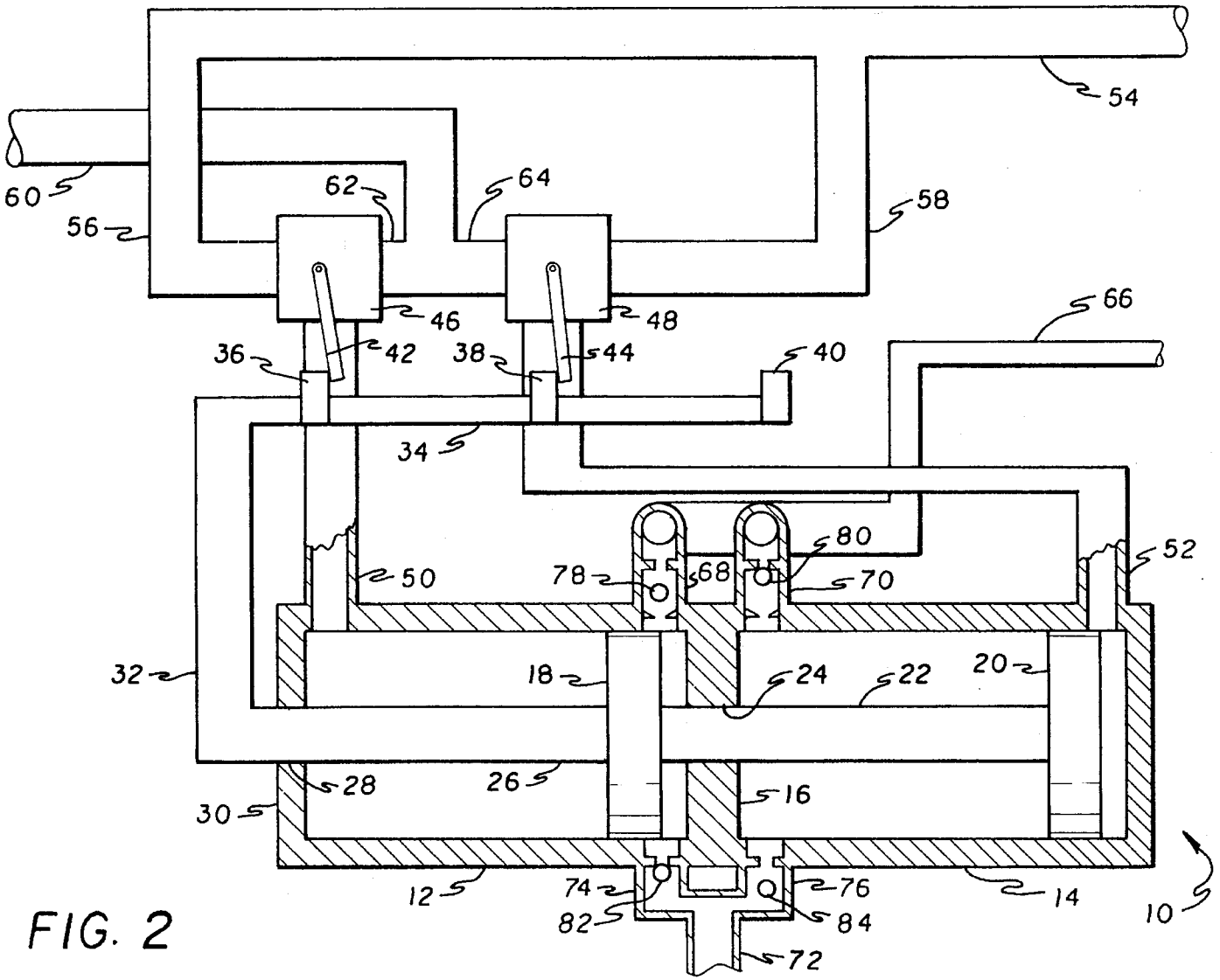
FIG. 2 is a schematic of the first embodiment of the present invention, which uses three-way valves and the middle two chambers for pumping product fluid, at the middle of the pumping cycle.

Referring to FIGS. 1–2, the first embodiment of the present invention is seen. The water driven pump 10 of FIGS. 1–2 includes first and second cylinders 12 and 14. Cylinders 12 and 14 are axially aligned such that their bores are in registry with one another, and they are positioned such that they abut one another end to end. The bores of the first and second cylinders 12 and 14 are separated by the partition 16. The cylinders 12 and 14 house pistons 18 and 20 respectively. The pistons 18 and 20 are slidably movable within the bores of cylinders 12 and 14, i.e. the pistons 18 and 20 are capable of reciprocating movement within the bores of cylinders 12 and 14 respectively. Pistons 18 and 20 are supported in a fluid-tight arrangement within cylinders 12 and 14 such that no significant fluid flow can occur around the pistons as they move within the bores of the cylinders. Sealing the gap between pistons 18 and 20 and the walls of respective cylinders 12 and 14 can be accomplished in any conventional manner. For example, O-rings (not shown) can be provided on the outer cylindrical walls of the pistons 18 and 20 to provide a fluid-tight seal around the pistons.

The pistons are connected by linking rod 22. Thus any displacement of piston 18 produces an equal displacement of piston 20. A central hole 24 in partition 16 slidably supports linking rod 22, and allows the linking rod 22 to pass from one cylinder to the other. A fluid-tight seal should be provided between linking rod 22 and hole 24. This fluid-tight seal can be of any well known construction. A piston rod 26 is connected to piston 18 and passes to the outside of cylinder 12 through a hole 28 in the wall 30 at the first end of cylinder 12. As before, a fluid-tight seal of any well known construction, should be provided between piston rod 26 and hole 28.

The outside end of piston rod 26 is connected to a connecting rod 32. Connecting rod 32 connects piston rod 26 to actuating rod 34. The actuating rod 34 has projections 36, 38, and 40 that actuate the levers 42 and 44 of valves 46 and 48. Valves 46 and 48 are three-way valves of a type well known in the art. Each of the valves 46 and 48 has one inlet and two outlets, and an operating lever, 42 and 44 respectively. Levers 42 and 44 are movable between a first position and a second position. With the valve lever in the first position fluid can flow between the inlet and the first outlet. With the valve lever in the second position fluid can flow between the inlet and the second outlet.

The inlet of valve 46 is connected to port 50 located proximate the first end of the first cylinder 12. The inlet of valve 48 is connected to port 52 located proximate the second end of the second cylinder 14. The first outlet of valve 46 is connected to a source of fluid under pressure 54 via conduit 56. The second outlet of valve 48 is connected to the same source of fluid under pressure 54 via conduit 58. The fluid under pressure is herein referred to as the working fluid. The second outlet of valve 46 is connected to a discharge pipe 60 via conduit 62. The first outlet of valve 48 is connected to the same discharge pipe 60 via conduit 64. Discharge pipe 60 normally discharges to the atmosphere.

Product fluid inlet 66 communicates with product fluid inlet ports 68 and 70 located on either side of partition 16. Product fluid outlet 72 communicates with product fluid outlet ports 74 and 76, also located on either side of partition 16. Check valves 78, 80, 82, and 84 provided at ports 68, 70, 74, and 76 respectively, regulate the flow of product fluid into and out of the cylinders 12 and 14. As an example, in fire fighting applications the product fluid would probably be a fire retardant foam, while the working fluid would most likely be water under pressure.

In operation, at the start of the pumping cycle, piston 18 is at its leftmost position. Also projections 38 and 40 are at their leftmost position placing both levers 42 and 44 in their first positions. At this point in the cycle therefore, fluid communication exists between port 50 and conduit 56 while conduit 62 is cut off from port 50. Also, fluid communication exists between port 52 and conduit 64 while conduit 58 is cut off from port 52. Thus water pressure from inlet 54 is directed to the left side of piston 18, while the right side of piston 20 is open to the discharge pipe 60. Therefore, a net force exists on the piston assembly including piston 18, piston 20, and rod 22, tending to push the piston assembly to the right.

During the stroke of the piston assembly to the right, as viewed in FIGS. 1–2, the left side of the piston 18 fills with working fluid, while working fluid is ejected from the right side of piston 20. Simultaneously, product fluid on the right side of piston 18 is ejected through check valve 82, and check valve 78 prevents back-flow of product fluid into inlet conduit 66. Also simultaneously, the left side of piston 20 fills with product fluid, check valve 80 being open and check valve 84 being closed, because the pressure on the left side of piston 20 is less than the pressure in conduit 66 and conduit 72.

Due to the action of connecting rod 32, actuating rod 34 moves to the right with the piston assembly. As the piston assembly nears the end of its movement to the right, projections 36 and 38 move levers 42 and 44 respectively to their second positions. Now the circumstances are reversed, working fluid pressure is applied to the right side of piston 20 while the left side of piston 18 is opened to the discharge pipe 60. Consequently, the piston assembly moves to the left, discharging product fluid from the left side of piston 20 while filling the right side of piston 18 with product fluid. As the piston assembly nears the end of its movement to the left, projections 38 and 40 move levers 42 and 44 respectively to their first positions. Once again, working fluid pressure is applied to the left side of piston 18 while the right side of piston 20 is opened to the discharge pipe 60, and the entire cycle can be repeated resulting in continuous pumping of the product fluid.

Figure 3:
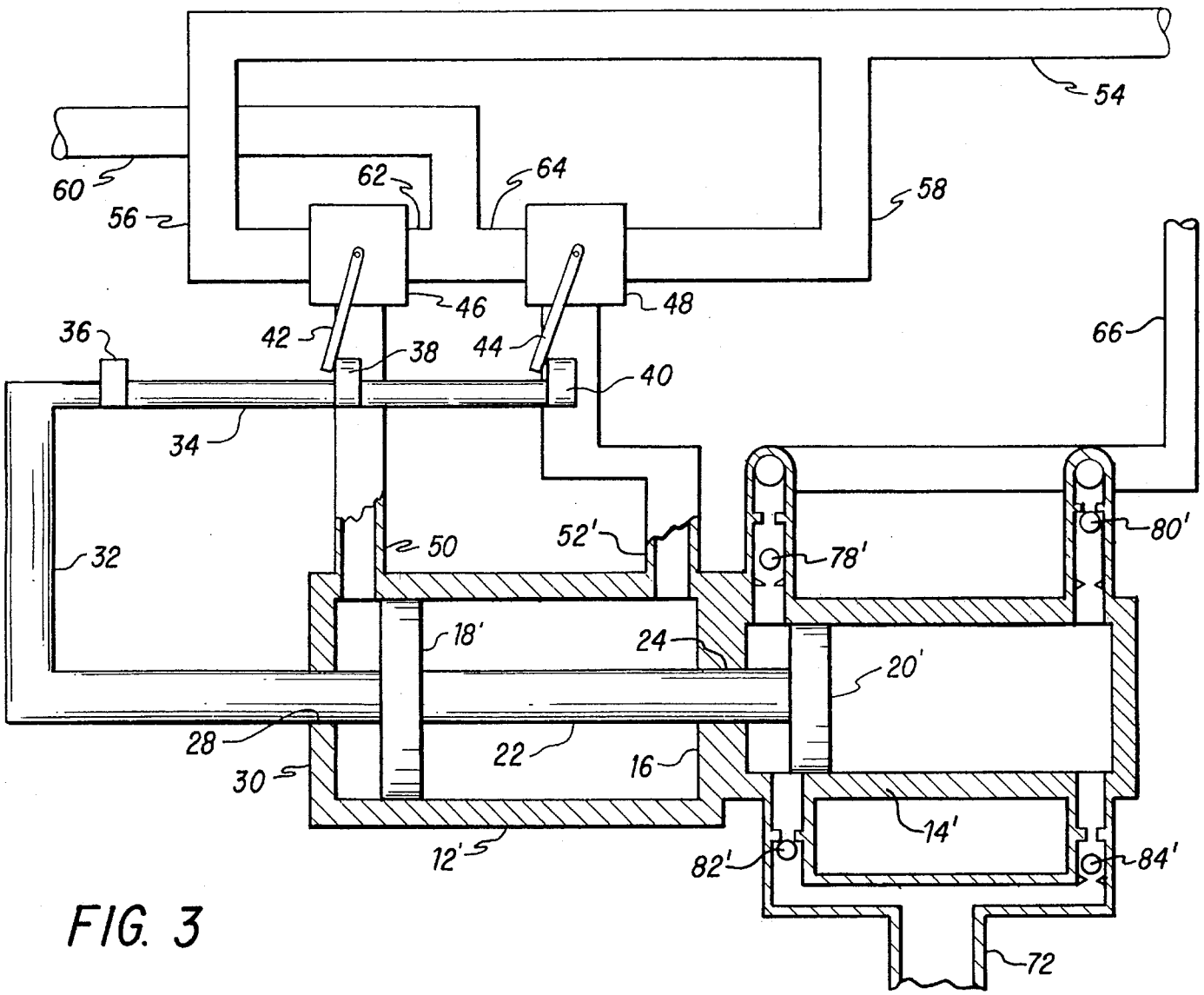
FIG. 3 is a schematic of the second embodiment of the present invention which uses three-way valves and the end two chambers for pumping product fluid.

Referring to FIG. 3 a second embodiment of the present invention is seen. The embodiment of FIG. 3 differs from that of FIGS. 1–2 in that the second cylinder 14' is used solely for the pumping of product fluid while the first cylinder 12' is used solely for driving the second cylinder 14'. In the embodiment of FIG. 3, at the start of the pumping cycle, piston 18' is at its leftmost position. Also projections 38 and 40 are at their leftmost position placing both levers 42 and 44 in their first positions. At this point in the cycle therefore, fluid communication exists between port 50 and conduit 56 while conduit 62 is cut off from port 50. Also, fluid communication exists between port 52' and conduit 64 while conduit 58 is cut off from port 52'. Thus water pressure from inlet 54 is directed to the left side of piston 18', while the right side of piston 18' is open to the discharge pipe 60. Therefore, a net force exists on the piston 18', tending to push the piston 18', rod 22, and piston 20' to the right.

During the stroke of the pistons to the right, as viewed in FIG. 3, the left side of the piston 18' fills with working fluid, while working fluid is ejected from the right side of piston 18'. Simultaneously, product fluid on the right side of piston 20' is ejected through check valve 84', and check valve 80' prevents backflow of product fluid into inlet conduit 66. Also simultaneously, the left side of piston 20' fills with product fluid, check valve 78' being open and check valve 82' being closed, because the pressure on the left side of piston 20' is less than the pressure in conduit 66 and conduit 72.

Due to the action of connecting rod 32, actuating rod 34 moves to the right with the pistons 18' and 20'. As the pistons near the end of their movement to the right, projections 36 and 38 move levers 42 and 44 respectively to their second positions. Now the circumstances are reversed, working fluid pressure is applied to the right side of piston 18' while the left side of piston 18' is opened to the discharge pipe 60. Consequently, the pistons 18',20' and rod 22 move to the left, discharging product fluid from the left side of piston 20' while filling the right side of piston 20' with product fluid. As the pistons near the end of their movement to the left, projections 38 and 40 move levers 42 and 44 respectively to their first positions. Once again, working fluid pressure is applied to the left side of piston 18' while the right side of piston 18' is opened to the discharge pipe 60, and the entire cycle can be repeated resulting in continuous pumping of the product fluid. In FIG. 3 the piston 20' is shown as having a smaller diameter than piston 18'. This feature, though not strictly required for proper operation, can be incorporated in the present invention when a greater pressure intensifying effect, than that obtainable from pistons of the same size, is desirable.

Figure 4:
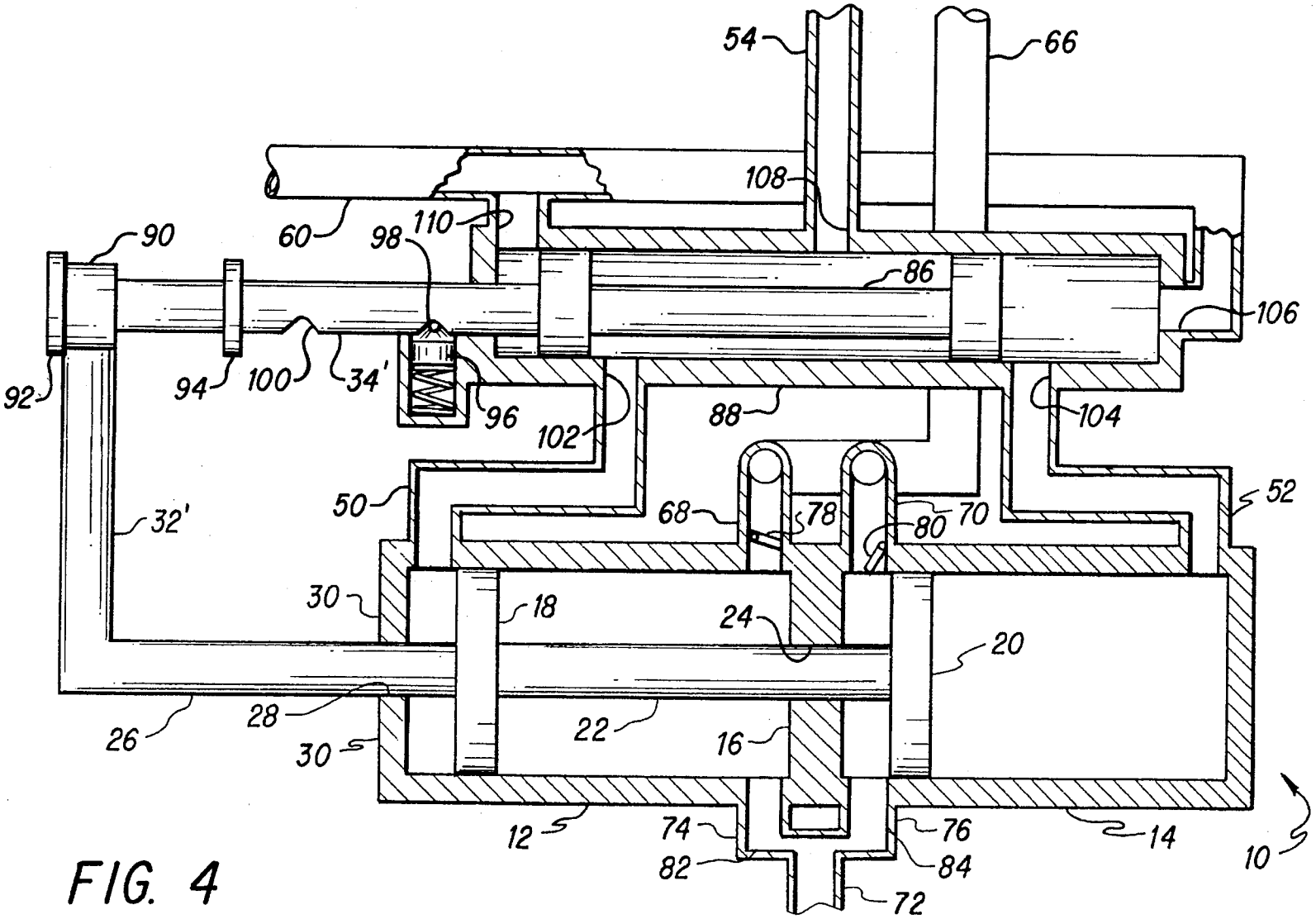
FIG. 4 is a schematic of the third embodiment of the present invention which uses a shuttle valve.

Referring to FIG. 4 a third embodiment of the present invention is seen. The embodiment of FIG. 4 uses a shuttle valve in place of the two three-way valves of the embodiment of FIGS. 12. 2. Also in the embodiment of FIG. 4, the actuating rod 34' lacks the projections 36, 38, and 40, is slidably connected to connecting rod 32', and has a dumbbell shaped slide 86 connected to one of its ends. The dumbbell shaped slide 86 is slidably housed in a cylindrical jacket 88 and is movable between a first position and a second position. The jacket 88 has first, second, third, fourth, and fifth inlets 102, 104, 106, 108, and 110. The large diameter portions of the dumbbell shaped slide 86 have substantially the same diameter as the internal bore of the jacket 88 and, in addition to being slidable within the bore of jacket 88, form a fluid-tight arrangement with the bore of the jacket 88. The connecting rod 32' has a ring 90 attached to one of its ends. Ring 90 slidably engages the portion of actuating rod 34' between stops 92 and 94 which are fixed to the actuating rod 34'. A spring loaded plunger 96 is engageable with notches 98 and 100 to retain slide 86 in the first and second positions respectively.

Except for the valve gear the embodiment of FIG. 4 is identical to that of FIGS. 1–2. At the start of the pumping cycle, piston 18 is at its leftmost position and slide 86 is in the first position. Ring 90 abuts stop 92 and plunger 96 is in engagement with notch 98. With slide 86 in the first position, fluid communication exists between port 50 and working fluid inlet 54 while conduit 60 is cut off from port 50. Also, fluid communication exists between port 52 and conduit 60 while conduit 54 is cut off from port 52. Thus water pressure from inlet 54 is directed to the left side of piston 18, while the right side of piston 20 is open to the discharge pipe 60. Therefore, a net force exists on the piston assembly including piston 18, piston 20, and rod 22, tending to push the piston assembly to the right.

During the stroke of the piston assembly to the right, as viewed in FIG. 4, the left side of the piston 18 fills with working fluid, while working fluid is ejected from the right side of piston 20. Simultaneously, product fluid on the right side of piston 18 is ejected through check valve 82, and check valve 78 prevents back-flow of product fluid into inlet conduit 66. Also simultaneously, the left side of piston 20 fills with product fluid, check valve 80 being open and check valve 84 being closed, because the pressure on the left side of piston 20 is less than the pressure in conduit 66 and conduit 72.

Connecting rod 32' moves to the right with the piston assembly, however actuating rod 34' remains stationary. As the piston assembly nears the end of its movement to the right, ring 90 contacts stop 94 moving slide 86 to the second position. Now the circumstances are reversed, working fluid pressure is applied to the right side of piston 20 w the left side of piston 18 is opened to the discharge pipe 6. Consequently, the piston assembly moves to the left, discharging product fluid from the left side of piston 20 while filling the right side of piston 18 with product fluid. As the piston assembly nears the end of its movement to the left, ring 90 contacts stop 92 returning slide 86 to the first position. Once again, working fluid pressure is applied to the left side of piston 18 while the right side of piston 20 is opened to the discharge pipe 60, and the entire cycle can be repeated resulting in continuous pumping of the product fluid.

Figure 5:
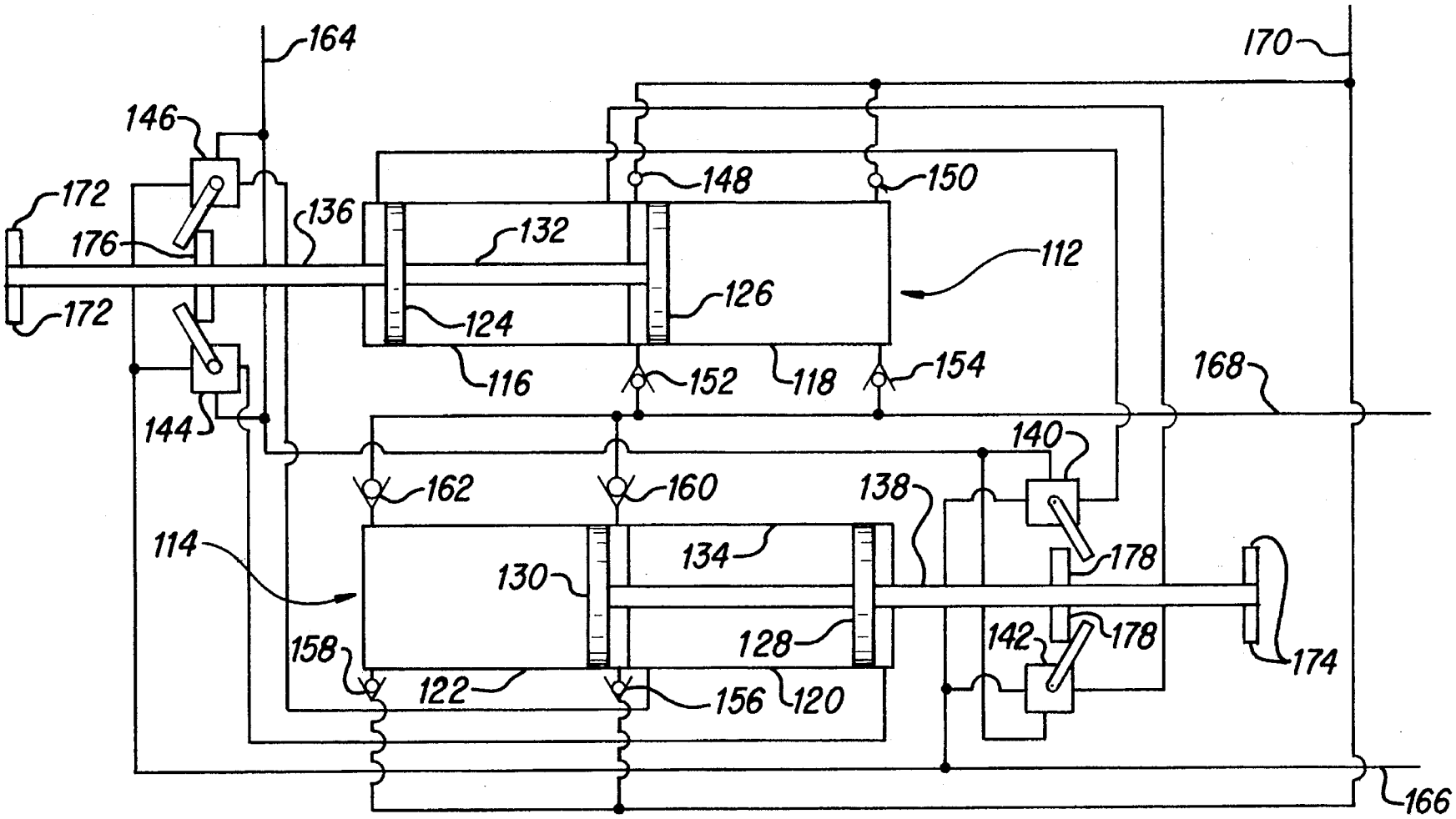
FIG. 5 is a schematic of the fourth embodiment of the present invention which uses two pumping units with one unit operating the valves of the other.

Referring to FIG. 5 a fourth embodiment of the present invention is seen. The embodiment of FIG. 5 includes two pump units 112 and 114. Each pump unit has two cylinders, unit 112 having a driving cylinder 116 and a pumping cylinder 118, while unit 114 has a driving cylinder 120 and a pumping cylinder 122. Cylinders 116, 118, 120, and 122 house pistons 124, 126, 128, and 130 respectively. Pistons 124 and 126 are connected by rod 132 and move in unison. Pistons 128 and 130 are connected by rod 134 and also move in unison. Piston rod 136 is connected to piston 124 and piston rod 138 is connected to piston 128.

Piston rods 138 and 136 protrude from units 114 and 112 respectively. Piston rod 138 operates three-way valves 140 and 142 which control the flow of working fluid to the driving cylinder 116, while piston rod 136 operates three-way valves 144 and 146 which control the flow of working fluid to the driving cylinder 120.

Pumping cylinder 118 has a pair of inlet check valves 148 and 150, and a pair of outlet check valves 152 and 154. Pumping cylinder 122 has a pair of inlet check valves 156 and 158, and a pair of outlet check valves 160 and 162.

At the start of the pump cycle valve 140 allows high pressure working fluid, from source line 164, to enter the left side of piston 124, while valve 144 allows high pressure working fluid, from source line 164, to enter the right side of piston 128. Valve 142 opens the right side of piston 124 to the working fluid discharge pipe 166, while valve 146 opens the left side of piston 128 to the working fluid discharge pipe 166. With the valves in this configuration, pistons 130 and 128 move to the left, while pistons 124 and 126 move to the right.

Product fluid is ejected from the left side of piston 130 and from the right side of piston 126, into the product fluid outlet 168, while product fluid from inlet pipe 170 fills the right side of piston 130 and the left side of piston 126. When pistons 124 and 126 near their rightmost positions, projections 172 at the end of piston rod 136 switch the configuration of valves 144 and 146. Similarly, when pistons 130 and 128 near their leftmost positions, projections 174 at the end of piston rod 138 switch the configuration of valves 140 and 142.

Now, valve 140 opens the left side of piston 124 to the working fluid discharge pipe 166, while valve 144 opens the right side of piston 128 to pipe 166. Valve 142 directs high pressure working fluid to the right side of piston 124, while valve 146 directs high pressure working fluid to the left side of piston 128. With the valves in this configuration, pistons 130 and 128 move to the right, while pistons 124 and 126 move to the left.

Product fluid is ejected from the right side of piston 130 and from the left side of piston 126, into the product fluid outlet 168, while product fluid from inlet pipe 170 fills the left side of piston 130 and the right side of piston 126. When pistons 124 and 126 near their leftmost positions, projections 176 on piston rod 136 switch the configuration of valves 144 and 146 to the configuration they had at the start of the cycle. Similarly, when pistons 130 and 128 near their rightmost positions, projections 178 on piston rod 138 switch the configuration of valves 140 and 142 back to their original configuration. Thus the entire cycle will now be repeated resulting in the continuous operation of the device as long as high pressure working fluid is supplied to the pipe 164.

Figure 6:
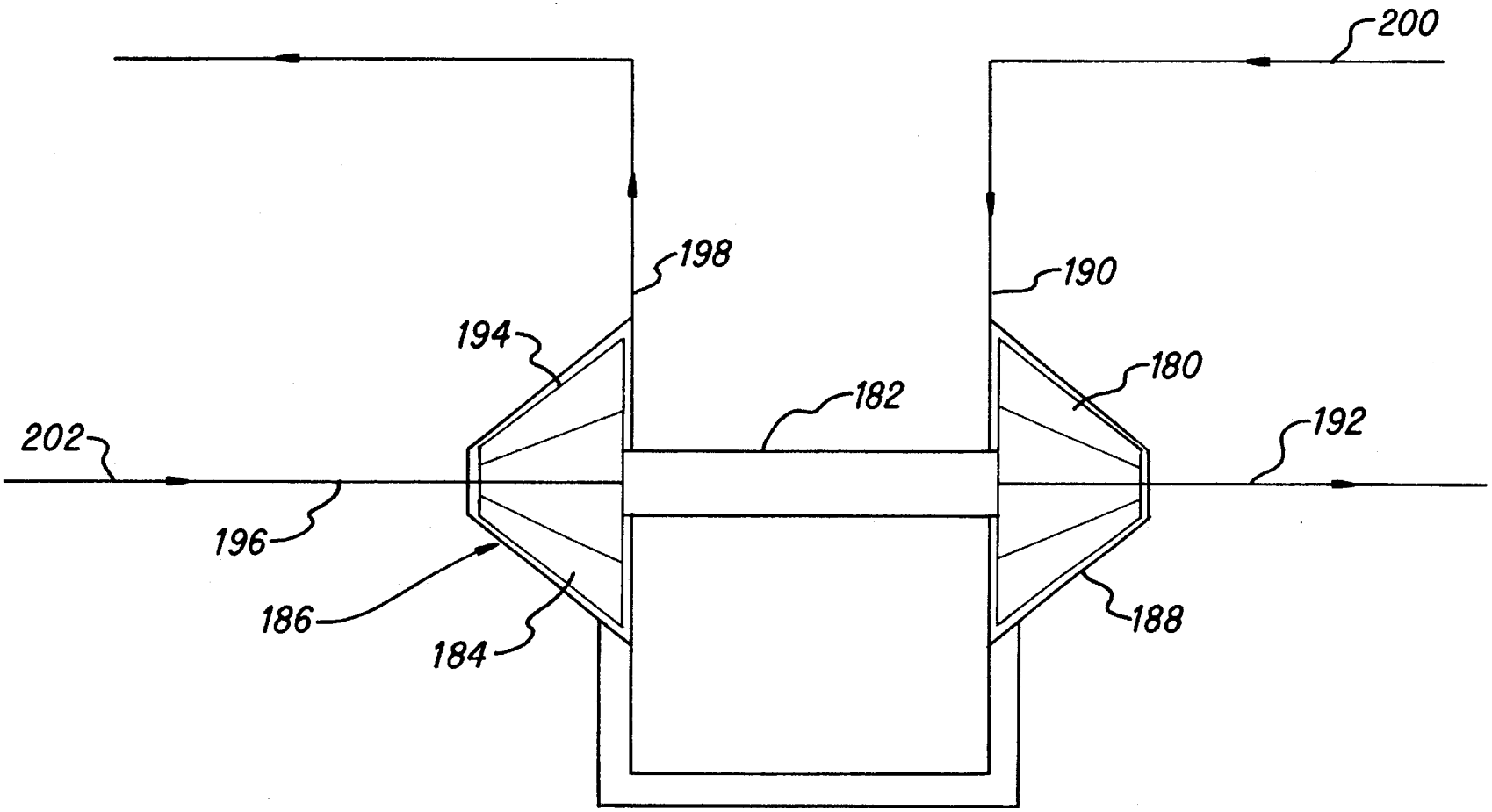
FIG. 6 is a schematic of the fifth embodiment of the present invention which uses a turbine to drive a centrifugal pump.

Referring to FIG. 6 a fifth embodiment of the present invention is seen. In the embodiment of FIG. 6 the high pressure working fluid drives a rotary turbine 180 which is rotatably supported on a common shaft 182 with the impeller 184 of a centrifugal pump 186.

The rotary turbine 180 is housed in a turbine casing 188 having a working fluid inlet 190 and a working fluid outlet 192. The centrifugal pump 186 includes a pump impeller 184 housed in a pump casing 194 having a product fluid inlet 196 and a product fluid outlet 198. The pump impeller 184 and the rotary turbine 180 are rotatably supported on a common shaft 182. Connecting the working fluid inlet 190 to a source of working fluid under pressure 200 causes rotation of the impeller 184 and consequent pumping of the product fluid from supply conduit 202.

It is to be understood that the present invention is not limited to the embodiments described above, but encompasses any and all embodiments within the scope of the following claims.

We claim:

1. A fluid driven pumping system driven by a working fluid under pressure to pump a product fluid, said fluid driven pumping system comprising:

a first cylinder having a first bore, a longitudinal axis, a first end, and a second end;

a second cylinder having a second bore, a first end, and a second end, said second cylinder being coaxial with said first cylinder and being attached to said first cylinder in an end-to-end configuration with said second end of said first cylinder adjacent said first end of said second cylinder;

a partition separating said first cylinder bore from said second cylinder bore, said partition having a first central opening;

a first piston disposed within said first cylinder bore, said first piston being slidably movable within said first cylinder bore;

a second piston disposed within said second cylinder bore, said second piston being slidably movable within said second cylinder bore;

a linking rod passing through said first central opening and said linking rod connecting said first piston to said second piston such that said first piston and said second piston move in unison;

an end wall located at said first end of said first cylinder, said end wall having a second central opening, portion of said first cylinder bore between said first piston and said end wall defining a first compartment, portion of said first cylinder bore between said first piston and said partition defining a second compartment, portion of said second cylinder bore between said second piston and said partition defining a third compartment, and portion of said second cylinder bore between said second piston and said second end of said second cylinder defining a fourth compartment;

a piston rod having first and second ends and passing through said second central opening, said piston rod being attached to said first piston at said second end of said piston rod;

an actuating rod having a longitudinal axis, a first end and a second end, said actuating rod being positioned such that said longitudinal axis of said actuating rod is parallel to and spaced apart from said longitudinal axis of said first cylinder, said actuating rod being movable between a first position and a second position;

a connecting rod attached to said first end of said piston rod, said connecting rod extending perpendicularly from said piston rod and engaging said actuating rod such that when said first piston is in reciprocating motion between a first extreme position and a second extreme position, said actuating rod assumes said first position in response to said first piston being in said first extreme position and said actuating rod assumes said second position in response to said first piston being in said second extreme position;

flow control means selectively configurable in a first configuration and a second configuration, said actuating rod engaging said flow control means at least momentarily when said actuating rod is in said first position and in said second position, said flow control means being in said first configuration when said actuating rod is in said first position and said flow control means being in said second configuration when said actuating rod is in said second position, said flow control means directing the flow of working fluid such that said first piston is caused to move away from said first extreme position when said flow control means is in said first configuration and said first piston is caused to move away from said second extreme position when said flow control means is in said second configuration; and at least one pair of check valves in communication with at least one of said compartments, said at least one pair of check valves for controlling product fluid entry into and ejection from said at least one of said compartments.

2. The fluid driven pumping system according to claim 1, wherein said flow control means is in fluid communication with a source of working fluid, a working fluid discharge pipe, said first compartment, and said fourth compartment, said flow control means directs the flow of working fluid into said first compartment while opening said fourth compartment to said working fluid discharge pipe when said flow control means is in said first configuration, and said flow control means directs the flow of working fluid into said fourth compartment while opening said first compartment to said working fluid discharge pipe when said flow control means is in said second configuration.

3. The fluid driven pumping system according to claim 2, wherein said second compartment ejects product fluid while said third compartment is filling with product fluid and said second compartment is filling with product fluid while said third compartment is ejecting product fluid, and said at least one pair of check valves includes first and second pairs of check valves in communication with said second compartment and said third compartment respectively, ejection and filling of said second compartment and said third compartment being controlled by said first and second pairs of check valves respectively.

4. The fluid driven pumping system according to claim 2, wherein said flow control means includes first and second three-way valves, each of said three-way valves having an inlet, a first outlet, a second outlet, and a control lever movable between a discharge position and a filling position, said inlet of said first three-way valve communicating with said first compartment, said first outlet of said first three-way valve communicating with the working fluid source, said second outlet of said first three-way valve communicating with the working fluid discharge pipe, said inlet of said second three-way valve communicating with said fourth compartment, said first outlet of said second three-way valve communicating with the working fluid discharge pipe, and said second outlet of said second three-way valve communicating with the working fluid source, said inlet of said first three-way valve communicating with said first outlet of said first three-way valve when said control lever of said first three-way valve is in said filling position, said inlet of said first three-way valve communicating with said second outlet of said first three-way valve when said control lever of said first three-way valve is in said discharge position, said inlet of said second three-way valve communicating with said first outlet of said second three-way valve when said control lever of said second three-way valve is in said discharge position, said inlet of said second three-way valve communicating with said second outlet of said second three-way valve when said control lever of said second three-way valve is in said filling position, said flow control means being in said first configuration when said control lever of said first three-way valve is in said filling position and said control lever of said second three-way valve is in said discharge position, said flow control means being in said second configuration when said control lever of said first three-way valve is in said discharge position and said control lever of said second three-way valve is in said filling position, and said actuating rod substantially simultaneously impinges upon said control lever of said first three-way valve and said control lever of said second three-way valve to move said control lever of said first three-way valve between said filling position and said discharge position in synchrony with the movement of said control lever of said second three-way valve between said discharge position and said filling position.

5. The fluid driven pumping system according to claim 4, wherein said second compartment ejects product fluid while said third compartment is filling with product fluid and said second compartment is filling with product fluid while said third compartment is ejecting product fluid, and said at least one pair of check valves includes first and second pairs of check valves in communication with said second compartment and said third compartment respectively, ejection and filling of said second compartment and said third compartment being controlled by said first and second pairs of check valves respectively.

6. The fluid driven pumping system according to claim 2, wherein said flow control means includes a shuttle valve, said shuttle valve including a slide slidably movable within a cylindrical jacket, said jacket communicating with said first compartment, said fourth compartment, the working fluid source, and the working fluid discharge pipe, said flow control means being in said first configuration when said slide is positioned within said jacket to allow communication between the working fluid source and said first compartment while allowing communication between the working fluid discharge pipe and said fourth compartment, said flow control means being in said second configuration when said slide is positioned within said jacket to allow communication between the working fluid discharge pipe and said first compartment while allowing communication between the working fluid source and said fourth compartment, and said actuating rod contacts said slide to slidably move said slide within said jacket.

7. The fluid driven pumping system according to claim 6, wherein said second compartment ejects product fluid while said third compartment is filling with product fluid and said second compartment is filling with product fluid while said third compartment is ejecting product fluid, and said at least one pair of check valves includes first and second pairs of check valves in communication with said second compartment and said third compartment respectively, ejection and filling of said second compartment and said third compartment being controlled by said first and second pairs of check valves respectively.

8. The fluid driven pumping system according to claim 1, wherein said flow control means is in fluid communication with a source of working fluid, a working fluid discharge pipe, said first compartment, and said second compartment, said flow control means directs the flow of working fluid into said first compartment while opening said second compartment to said working fluid discharge pipe when said flow control means is in said first configuration, and said flow control means directs the flow of working fluid into said second compartment while opening said first compartment to said working fluid discharge pipe when said flow control means is in said second configuration.

9. The fluid driven pumping system according to claim 8, wherein said fourth compartment ejects product fluid while said third compartment is filling with product fluid and said fourth compartment is filling with product fluid while said third compartment is ejecting product fluid, and said at least one pair of check valves includes first and second pairs of check valves in communication with said forth compartment and said third compartment respectively, ejection and filling of said fourth compartment and said third compartment being controlled by said first and second pairs of check valves respectively.

10. The fluid driven pumping system according to claim 8, wherein said flow control means includes first and second three-way valves, each of said three-way valves having an inlet, a first outlet, a second outlet, and a control lever movable between a discharge position and a filling position, said inlet of said first three-way valve communicating with said first compartment, said first outlet of said first three-way valve communicating with the working fluid source, said second outlet of said first three-way valve communicating with the working fluid discharge pipe, said inlet of said second three-way valve communicating with said second compartment, said first outlet of said second three-way valve communicating with the working fluid discharge pipe, and said second outlet of said second three-way valve communicating with the working fluid source, said inlet of said first three-way valve communicating with said first outlet of said first three-way valve when said control lever of said first three-way valve is in said filling position, said inlet of said first three-way valve communicating with said second outlet of said first three-way valve when said control lever of said first three-way valve is in said discharge position, said inlet of said second three-way valve communicating with said first outlet of said second three-way valve when said control lever of said second three-way valve is in said discharge position, said inlet of said second three-way valve communicating with said second outlet of said second three-way valve when said control lever of said second three-way valve is in said filling position, said flow control means being in said first configuration when said control lever of said first three-way valve is in said filling position and said control lever of said second three-way valve is in said discharge position, said flow control means being in said second configuration when said control lever of said first three-way valve is in said discharge position and said control lever of said second three-way valve is in said filling position, and said actuating rod substantially simultaneously impinges upon said control lever of said first three-way valve and said control lever of said second three-way valve to move said control lever of said first three-way valve between said filling position and said discharge position in synchrony with the movement of said control lever of said second three-way valve between said discharge position and said filling position.

11. The fluid driven pumping system according to claim 10, wherein said fourth compartment ejects product fluid while said third compartment is filling with product fluid and said fourth compartment is filling with product fluid while said third compartment is ejecting product fluid, and said at least one pair of check valves includes first and second pairs of check valves in communication with said forth compartment and said third compartment respectively, ejection and filling of said fourth compartment and said third compartment being controlled by said first and second pairs of check valves respectively.

12. The fluid driven pumping system according to claim 11, wherein said second piston has a smaller diameter than said first piston.

* * * * *